US007680294B2

(12) United States Patent
Kajiwara et al.

(10) Patent No.: US 7,680,294 B2
(45) Date of Patent: Mar. 16, 2010

(54) ACOUSTIC TRANSDUCER

(75) Inventors: Hiroo Kajiwara, Fujiyoshida (JP); Kazumi Miyamoto, Fujiyoshida (JP)

(73) Assignee: Citizen Electronics Co., Ltd., Fujiyoshida-shi, Yamanashi-ken (JP)

( * ) Notice: Subject to any disclaimer, the term of this patent is extended or adjusted under 35 U.S.C. 154(b) by 1079 days.

(21) Appl. No.: 11/346,010

(22) Filed: Feb. 2, 2006

(65) Prior Publication Data

US 2006/0171554 A1 Aug. 3, 2006

(30) Foreign Application Priority Data

Feb. 3, 2005 (JP) ..... 2005-028170

(51) Int. Cl.
*H04R 25/00* (2006.01)

(52) U.S. Cl. ..... 381/396; 381/412

(58) Field of Classification Search ..... 381/162, 381/396, 398, 400, 402, 407, 412
See application file for complete search history.

(56) References Cited

U.S. PATENT DOCUMENTS 7,110,564 B2 * 9/2006 Son ..... 381/396
2002/0076077 A1 * 6/2002 Kobayashi et al. ..... 381/396
2002/0114486 A1 * 8/2002 Fukawatase et al. ..... 381/401
2005/0180593 A1 8/2005 Kajiwara et al.

FOREIGN PATENT DOCUMENTS

| | | |
|---|---|---|
| EP | 1297904 | 4/2003 |
| EP | 1308220 | 5/2003 |
| JP | 2001-225010 | 8/2001 |
| WO | WO2005/025076 | 3/2005 |

OTHER PUBLICATIONS

GB Search Report dated May 12, 2006.

* cited by examiner

*Primary Examiner*—Suhan Ni
(74) *Attorney, Agent, or Firm*—Brinks Hofer Gilson & Lione

(57) ABSTRACT

An acoustic transducer includes a magnetic circuit part and a voice coil operatively connected to the magnetic circuit part. A tubular casing accommodates the magnetic circuit part and the voice coil. An annular first support spring has an outer peripheral portion embedded and secured in the casing. The first support spring extends radially inward from the inner peripheral surface of the casing and has an inner peripheral portion abutting on and fixed to the magnetic circuit part. An annular second support spring has an outer peripheral portion abutting on and fixed to one end portion of the casing. The second support spring extends radially inward and has an inner peripheral portion abutting on and fixed to the magnetic circuit part.

7 Claims, 2 Drawing Sheets

ACOUSTIC TRANSDUCER

This application claims priority under 35 U.S.C. §119 to Japanese Patent Application No. 2005-028170 filed Feb. 3, 2005, the entire content of which is hereby incorporated by reference.

BACKGROUND OF THE INVENTION

1. Field of the Invention

The present invention relates to an acoustic transducer that may be incorporated in a mobile cellular phone or other mobile communication devices to generate sound or vibration in response to an electric signal.

2. Description of the Background Art

Conventionally, mobile communication devices, e.g. cellular phones and PDAs, are arranged to inform the user of an incoming call by generating beep sound or melody sound, or by vibrating the enclosure of the device instead of producing sound when a "manner mode" has been selected. For this purpose, the conventional practice is to employ a structure incorporating a combination of a compact speaker and a vibrator that generates vibration by rotating an eccentric weight with a compact motor. Incorporating both the speaker and the vibrator as stated above, however, is disadvantageous from the viewpoint of achieving size and cost reduction of the device. Under these circumstances, a magnetically driven acoustic transducer capable of generating both sound and vibration by itself has been used recently.

FIG. 2 is a side view showing an example of such an acoustic transducer. The left-hand side of the figure is a sectional view showing the internal arrangement. The acoustic transducer has a tubular casing formed by joining together upper and lower casing segments 1 and 2 made of a plastic material. A protector 11 is secured to the top of the casing. Another protector 12 is secured to the bottom of the casing. The casing accommodates a diaphragm 9 and a magnetic exciter that vibrates the diaphragm 9. The magnetic exciter includes a voice coil 10 secured to the diaphragm 9 and a magnetic circuit part operatively (i.e. magnetically) connected to the voice coil 10. The magnetic circuit part includes annular lower and upper pole pieces 3 and 5 made of a magnetic material and an annular permanent magnet 4 sandwiched between the pole pieces 3 and 5. The lower pole piece 3 is provided with a cylindrical portion 3*a* extending upward from the inner peripheral edge thereof. A weight 6 is secured in the cylindrical portion 3*a*. The voice coil 10 extends into a magnetic gap g between the cylindrical portion 3*a* of the lower pole piece 3 and the upper pole piece 5.

An upper support spring 7 and a lower support spring 8 are secured to the top and bottom, respectively, of the magnetic circuit part. The respective outer peripheries of the two support springs 7 and 8 are secured to the casing for resiliently supporting the magnetic circuit part with respect to the casing. In connection with this, please refer to FIG. 1B in which a lower support spring 14 used in an acoustic transducer in accordance with the present invention is illustrated. As will be described in detail later, the lower support spring 14 comprises an inner annular portion 14*b*, an outer annular portion 14*a* and arcuate connecting portions 14*c*, 14*c* between the inner and outer annular portions. The support springs 7 and 8 of the prior art may be configured in the same shape as the lower support spring 14. The inner annular portion of the upper support spring 7 is joined to the upper side of the upper pole piece 5 by spot welding or the like. The inner annular portion of the lower support spring 8 is joined to the lower side of the lower pole piece 3.

Meanwhile, the outer annular portions of the support springs 7 and 8 are embedded and secured in the upper and lower casing segments 1 and 2, respectively, by insert molding. Thus, the magnetic circuit part is suspended by using two support springs, thereby allowing the magnetic circuit part to vibrate vertically without tilting, and thus preventing either the upper pole piece 5 or the lower pole piece 3 from contacting the voice coil 10, which would otherwise generate noise or cause breakage of components.

An example of the above-described double-sided suspension is found, for example, in Japanese Patent Application Publication (KOKAI) No. 2000-333282.

In the above-described acoustic transducer, when a driving signal of a certain frequency in an audio-frequency region is applied to the coil 10, the diaphragm 9, which has the voice coil 10 secured thereto, vibrates to generate sound, e.g. beep sound or voice. The magnetic circuit part supported by the support springs 7 and 8, however, does not substantially vibrate because its natural frequency is low. If the frequency of the driving signal is lower than the audio-frequency region, the vibration of the diaphragm 9 is so weak that no sound is generated, but instead the magnetic circuit part vibrates. The vibration of the magnetic circuit part is transmitted through the casing to the device incorporating the transducer, thus causing vibration of the device itself, but not making sound.

In the above-described acoustic transducer, the upper and lower casing segments 1 and 2 have the insert-molded support springs 7 and 8, respectively. The casing segments 1 and 2 are butt-joined together by ultrasonic welding and thus assembled into the casing. In the assembling process, it is difficult to join together the two casing segments 1 and 2 precisely so that the two support springs 7 and 8 are set parallel to each other. Consequently, the resonance frequency is likely to be displaced, causing the quality of the device to become unstable. The yield is also likely to be reduced.

SUMMARY OF THE INVENTION

Accordingly, an object of the present invention is to provide an acoustic transducer that allows two support springs to be readily set parallel to each other and hence has stabilized quality.

The present invention provides an acoustic transducer including a magnetic circuit part and a voice coil operatively connected to the magnetic circuit part. A tubular casing accommodates the magnetic circuit part and the voice coil. An annular first support spring has an outer peripheral portion embedded and secured in the casing. The first support spring extends radially inward from the inner peripheral surface of the casing and has an inner peripheral portion abutting on and fixed to the magnetic circuit part. An annular second support spring has an outer peripheral portion abutting on and fixed to one end portion of the casing. The second support spring extends radially inward and has an inner peripheral portion abutting on and fixed to the magnetic circuit part.

In the acoustic transducer, the second support spring is prepared separately from the casing. The second support spring is brought into abutment on and fixed to one end portion of the casing. Therefore, it becomes easy to secure the second support spring to the casing in parallel to the first support spring.

In addition, frequency adjustment to change the frequency setting can be made simply by replacing the above-described second support spring with a second support spring having a different spring thickness. More specifically, the second support spring to be used is brought into abutment both on the casing and the magnetic circuit part and fixed thereto with an adhesive or the like. It is unnecessary to prepare a different mold for insert molding as required for the above-described conventional acoustic transducer. Thus, frequency adjustment can be made easily.

Specifically, the arrangement may be as follows. The one end portion of the casing has an annular recess provided along the inner peripheral surface of the one end portion. The annular recess has a radial surface extending radially outward from the inner peripheral surface of the casing toward the outer peripheral surface thereof. The annular recess further has an axial surface extending in the axial direction of the casing from the outer peripheral edge of the radial surface to intersect the end surface of the one end portion. The outer peripheral portion of the second support spring is fitted into the annular recess to abut on the radial surface of the annular recess and fixed to the radial surface.

That is, the second support spring is brought into abutment on and fixed to the radial surface, thereby enabling the second support spring to be set parallel to the first support spring without the need for a special jig.

The second support spring can be positioned in the circumferential direction of the casing (i.e. about the axis of the casing) by being fitted into the annular recess. By so doing, it is possible to set a predetermined positional relationship between the second support spring and the first support spring in the circumferential direction.

In other words, the positional relationship between the second support spring and the first support spring in the circumferential direction can be set by fitting the second support spring into the annular recess.

Specifically, the arrangement may be such that the one end portion of the casing is provided with an engaging recess extending radially outward further from the axial surface of the annular recess, and the outer peripheral portion of the second support spring has a radial projecting portion engageable with the engaging recess.

Specifically, the magnetic circuit part may have a permanent magnet, and first and second pole pieces fixed to opposite end portions, respectively, of the permanent magnet in the axial direction of the casing. With this arrangement, the first support spring is brought into abutment on and fixed to the end surface of the first pole piece, and the second support spring is brought into abutment on and fixed to the end surface of the second pole piece.

More specifically, the arrangement may be as follows. The permanent magnet and the first and second pole pieces are annular and coaxially superimposed on one another. The second pole piece has a cylindrical portion extending in the axial direction from the inner peripheral edge thereof toward the first pole piece to form a magnetic gap between itself and the first pole piece. The voice coil is set to extend into the magnetic gap in the axial direction.

Preferably, a securing ring is fitted in the annular recess to press the outer peripheral portion of the second support spring against the radial surface of the annular recess.

The above and other objects, features and advantages of the present invention will become more apparent from the following description of the preferred embodiments thereof, taken in conjunction with the accompanying drawings.

DESCRIPTION OF THE PREFERRED EMBODIMENTS

Figure 1A:
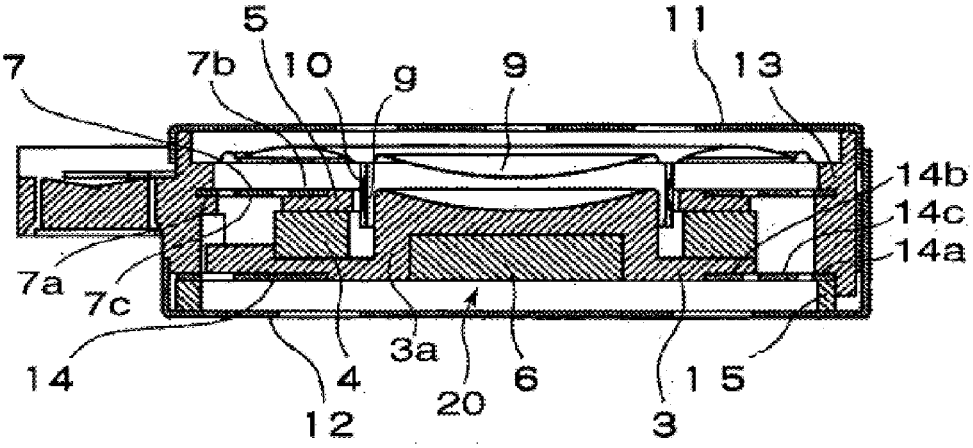
FIG. 1A is a sectional view of an acoustic transducer according to the present invention, taken along the line 1A-1A in FIG. 1B.

An embodiment of the acoustic transducer according to the present invention will be explained below with reference to FIGS. 1A and 1B of the accompanying drawings.

As shown in the figures, the acoustic transducer according to the present invention has a tubular casing 13 made of a plastic material. Protectors 111 and 12 are secured to the top and bottom, respectively, of the casing 13. A diaphragm 9 and a magnetic circuit part 20 are accommodated in the casing 13. The magnetic circuit part 20 includes annular lower and upper pole pieces 3 and 5 made of a magnetic material and an annular permanent magnet 4 sandwiched between the pole pieces 3 and 5. The lower pole piece 3 is provided with a cylindrical portion 3*a* extending upward from the inner peripheral edge thereof. A weight 6 is loaded in the cylindrical portion 3*a*. A magnetic gap g is formed between the cylindrical portion 3*a* of the lower pole piece 3 and the upper pole piece 5. A voice coil 10 secured to the diaphragm 9 extends into the magnetic gap g.

The magnetic circuit part 20 is resiliently supported with respect to the casing 13 by upper and lower support springs 7 and 14.

Figure 1B:
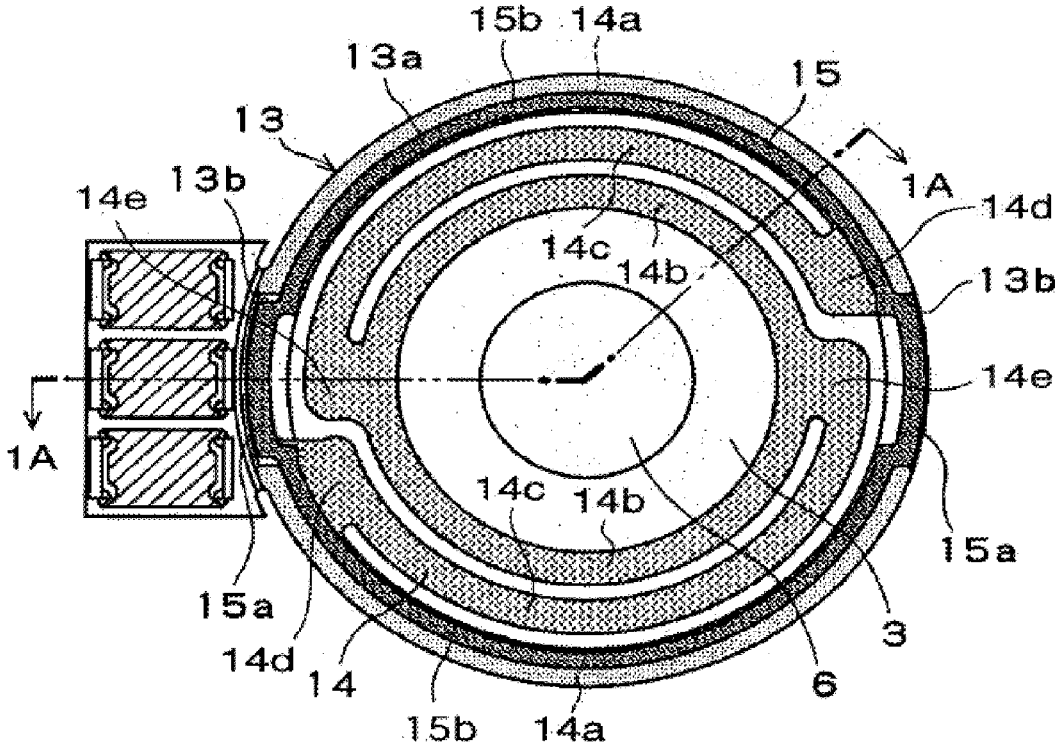
FIG. 1B is a diagram showing the acoustic transducer of FIG. 1A as seen from the lower side thereof, which illustrates the relationship between the lower end surface of a casing, a securing ring and a lower support spring, in which illustration of other constituent elements is omitted to clearly show the arrangement of the essential part of the acoustic transducer.
Figure 2:
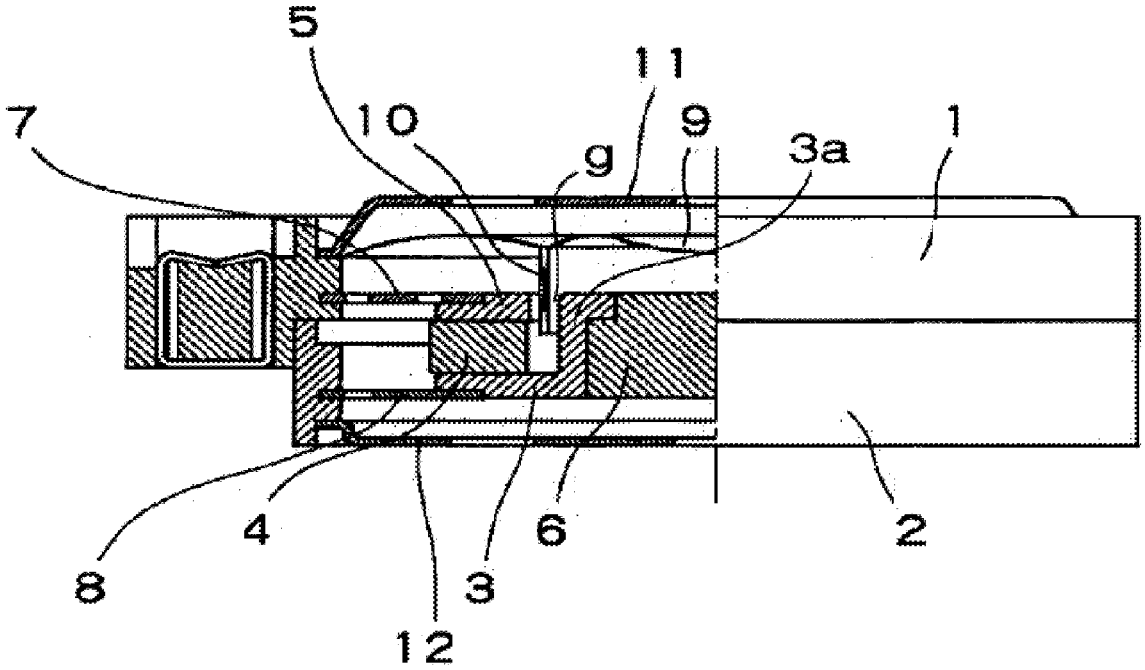
FIG. 2 is a side view of a conventional acoustic transducer, in which the left-hand half of the transducer is shown in a sectional view.

That is, the lower support spring 14 is, as shown in FIGS. 1A and 1B, securely bonded to a lower end portion of the casing 13 with an adhesive and secured to the lower end portion by a metallic securing ring 15 which is urged against the spring.

More specifically, the securing ring 15 is substantially annular and has radial projecting portions 15*a* at diametrically opposing positions. On the other hand, the lower end portion of the casing 13 is formed with an annular recess 13*a* to be fitted with an annular portion 15*b* of the securing ring 15 and radial cut portions 13*b* to be fitted with the radial projecting portions 15*a* of the securing ring 15. The lower support spring 14 has an outer annular portion 14*a* with substantially the same shape as that of the securing ring 15. The lower support spring 14 further has an inner annular portion 14*b* concentric with respect to the outer annular portion 14*a* and spot-welded to the lower side of the lower pole piece 3, and circular arc portions 14*c* positioned between the outer and inner annular portions 14*a* and 14*b* (as shown in FIG. 1B). Each circular arc portion 14*c* is connected at one end 14*d* thereof to the outer annular portion 14*a* and at the other end 14*e* thereof to the inner annular portion 14*b*.

The upper support spring 7 has substantially the same shape as that of the lower support spring 14. The casing 13 is insert-molded to embed the outer annular portion 7*a* of the upper support spring 7. The inner annular portion 7*b* is spot-welded to the upper side of the upper pole piece 5.

The upper support spring 7 is centered relative to the casing 13 and positioned in the circumferential direction about the axis of the casing 13 by using a jig at the stage of insert-molding the casing 13. On the other hand, the lower support spring 14 is centered relative to the casing 13 by fitting the outer annular portion 14*a* into the annular recess 13*a* of the casing 13. Circumferential positioning of the lower support spring 14 relative to the casing 13 is effected by fitting its radial projecting portions corresponding to the radial projecting portions 15*a* of the securing ring 15 into the radial cut portions 13*b*. The upper support spring 7 and the lower support spring 14 in this embodiment are preferably displaced 90° relative to each other in the circumferential direction.

Although an embodiment of the acoustic transducer according to the present invention has been described above, the present invention is not necessarily limited thereto. In the foregoing embodiment, for example, circumferential positioning of the lower support spring 14 is effected by combining together the radial cut portions 13*b* of the casing 13 and the radial projecting portions of the lower support spring 14. The circumferential positioning of the lower support spring 14, however, may be made as follows. The lower support spring 14 is formed into a non-circular shape as a whole without radial projecting portions, and the recess 13*a* that receives the lower support spring 14 is formed into a non-circular shape corresponding to the shape of the lower support spring 14.

Although the present invention has been described in terms of specific embodiments, it is anticipated that alternations and modifications thereof will no doubt become apparent to those skilled in the art. It is therefore intended that the following claims be interpreted as covering all such alternations and modifications as fall within the true sprit and scope of the invention.

What is claimed is:

1. An acoustic transducer comprising:

a magnetic circuit part;

a voice coil operatively connected to the magnetic circuit part;

a tubular casing accommodating the magnetic circuit part and the voice coil;

an annular first support spring having an outer peripheral portion embedded and secured in the casing, the first support spring extending radially inward from the outer peripheral portion embedded and secured in the casing and having an inner peripheral portion abutting on and fixed to the magnetic circuit part;

the casing having an annular recess provided at its lower end portion, the annular recess having a radial surface extending radially outward from an inner peripheral surface of the casing toward an outer peripheral surface of the casing;

an annular second support spring having an outer peripheral portion abutting on and fixed to the lower end portion of the casing, the second support spring extending radially inward and having an inner peripheral portion abutting on and fixed to the magnetic circuit part; and a securing ring fitted in the annular recess at the lower end portion of the casing and secured to press the outer peripheral portion of the second support spring against the radial surface of the annular recess.

2. The acoustic transducer according to claim 1, the annular recess further having an axial surface extending in an axial direction of the casing from an outer peripheral edge of the radial surface to intersect the radial surface of the lower end portion; and further wherein the outer peripheral portion of the second support spring is fitted into the annular recess to abut on the radial surface of the annular recess and fixed to the radial surface.

3. The acoustic transducer according to claim 2, wherein the second support spring is positioned in a circumferential direction of the casing by being fitted into the annular recess.

4. The acoustic transducer according to claim 3, wherein the lower end portion of the casing is provided with an engaging recess extending radially outward further from the axial surface of the annular recess, and the outer peripheral portion of the second support spring has a radial projecting portion engageable with the engaging recess.

5. The acoustic transducer according to claim 4, wherein the magnetic circuit part has a permanent magnet, and first and second pole pieces fixed to opposite end portions, respectively, of the permanent magnet in the axial direction of the casing;

the first support spring abutting on and fixed to an end surface of the first pole piece; and the second support spring abutting on and fixed to an end surface of the second pole piece.

6. The acoustic transducer according to claim 5, wherein the permanent magnet and the first and second pole pieces are annular and coaxially superimposed on one another;

the second pole piece having an annular portion and a cylindrical portion extending in the axial direction from an inner peripheral edge of the annular portion toward the first pole piece to form a magnetic gap between the second pole piece and the first pole piece; and the voice coil extending into the magnetic gap in the axial direction.

7. The acoustic transducer according to claim 1, wherein the securing ring has radial projecting portions at diametrically opposing positions, and the casing has radial cut portions in which the projecting portions of the securing ring are fitted.

* * * * *